US006213838B1

(12) United States Patent
Amaral

(10) Patent No.: US 6,213,838 B1
(45) Date of Patent: Apr. 10, 2001

(54) METAL YO-YO AND METHOD FOR MANUFACTURE

(76) Inventor: Leonard R. Amaral, 82R Plain St., Rehoboth, MA (US) 02769

( * ) Notice: Subject to any disclaimer, the term of this patent is extended or adjusted under 35 U.S.C. 154(b) by 0 days.

(21) Appl. No.: 09/097,520

(22) Filed: Jun. 15, 1998

(51) Int. Cl.[7] ..... A63H 1/30
(52) U.S. Cl. ..... 446/250; 446/261
(58) Field of Search ..... 446/250, 245, 446/261, 235

(56) References Cited

U.S. PATENT DOCUMENTS

| | | | |
|---|---|---|---|
| 2,579,022 | 12/1951 | Spencer | 446/250 |
| 2,891,351 | 6/1959 | Madras | 446/250 |
| 3,175,326 | 3/1965 | Isaacson | 446/250 |
| 3,643,373 | 2/1972 | Russell | 446/245 |
| 3,936,974 | 2/1976 | House | 446/250 |
| 3,953,936 | 5/1976 | Ennis . | |
| 4,895,547 | 1/1990 | Amaral | 446/250 |
| 5,100,361 | 3/1992 | Kuhn | 446/250 |
| 5,813,897 | 9/1998 | Van Dan Elzen | 446/250 |

FOREIGN PATENT DOCUMENTS

| | | |
|---|---|---|
| 197 31 087 A1 | 7/1997 | (DE) . |
| 297 12 814 U1 | 9/1997 | (DE) . |
| 197 31 087 | 5/1998 | (DE) . |
| 2 087 453 | 12/1971 | (FR) . |
| 2200853A | 8/1988 | (GB) . |

*Primary Examiner*—Kien T. Nguyen
(74) *Attorney, Agent, or Firm*—Arthur Z. Bookstein

(57) ABSTRACT

A metal yo-yo embodies a construction in which each of the halves of the yo-yo body is formed from a disc and a hub that are made separately and secured to each other in an integral structure. The discs can be die cut from sheet material and may be deformed about the peripheral margin to define a dished configuration. The hub is inserted into the center hole of the disc and the two are assembled together in a swaging operation that constricts the metal of the disc about a portion of the hub. A pair of such yo-yo halves are connected together by an axle assembly that includes a bearing to facilitate extended spin time for the yo-yo. The yo-yo construction and method of fabrication provides substantial economies in the manufacture of metal yo-yos.

13 Claims, 7 Drawing Sheets

METAL YO-YO AND METHOD FOR MANUFACTURE

FIELD OF THE INVENTION

This invention relates to yo-yos and particularly to yo-yos fabricated from metal.

BACKGROUND OF THE INVENTION

Yo-yos most commonly are made from wood or from a molded plastic as the principal material of construction. Yo-yos made from different materials present a different feel to the yo-yo player, some players preferring the feel of one over the other. Some yo-yos have been made from metal which presents still another feel that may be preferred by some players. Few metal yo-yos have been commercialized, however, and, as to those, their availability has been limited possibly because the typical construction for such yo-yos is costly and is substantially more than that of a more conventional yo-yo made from plastic or wood. In one prior art construction, the metal yo-yo may be formed from aluminum by machining the yo-yo halves that will be assembled to form the yo-yo body in a milling machine from solid round aluminum bar stock. The entire yo-yo half is formed, in one piece, from the round aluminum bar stock. The end of the bar stock is milled to form the outer face of the yo-yo half by removing an annular region of material, leaving a center hub and a peripheral rim. The peripheral contour of the yo-yo half also may be milled, as may be the inner face of the yo-yo half. The milled piece then is cut-off from the round bar stock to a thickness appropriate for the yo-yo half. The inner face of the yo-yo half then is machined further by drilling and tapping a center hole along the central axis of the yo-yo half to accept the threaded end of an axle by which two yo-yo halves will be joined. After machining, the yo-yo halves then are individually polished and finished. Such one-piece yo-yo halves are made individually in a labor intensive process that is wasteful of material, all of which adds to the cost of the yo-yo.

Also among the desirable features of a yo-yo, especially for those users who wish to perform complex string tricks, is to provide a wide peripheral entry to the string slot between the yo-yo halves. Yo-yos having such a wide entry sometimes are referred to as having a "butterfly" configuration. While incorporating a butterfly configuration in a plastic injection molded yo-yo is simply a matter of configuring the mold for the yo-yo halves, the fabrication of a butterfly yo-yo from metal, using the prior art milling technique described above, presents additional difficulties in milling the peripheral surfaces as well as the inner surfaces of the yo-yo halves. Such milling results in still further waste of material and additional labor and other expenses attendant to finishing the surfaces of the yo-yo halves. The milled one-piece metal yo-yo involves a machining process that can be expected to leave marks and other irregular surface regions that should be finished to a smoother surface in order to accept a desired finish, such as anodizing or finishing graphics. The milled metal yo-yo halves do not lend themselves to mass finishing but, instead, must be finished individually, adding further to the cost of the yo-yo.

It would be desirable to provide a metal yo-yo embodying a construction and method of manufacture that would reduce substantially the cost and ease of manufacture while providing a metal yo-yo with desirable characteristics, including the ability to form a butterfly yo-yo.

SUMMARY OF THE INVENTION

In accordance with the invention, each yo-yo half is made in two pieces, including a die cut, stamped body and a central hub attached to the body, both components being formed from a suitable metal. The body is made by die cutting an annular disc from a flat sheet of metal, the disc having a central hole adapted to receive the hub. A plurality of such discs can be die cut simultaneously from a larger sheet. Each flat disc then is subjected to a drawing process in which the disc is deformed about its periphery to form a flared rim that, in an assembled yo-yo, may cooperate with another such disc to define a wide butterfly entry to the string slot. A plurality of the drawn discs can be polished together in a mass polishing machine together with a suitable polishing grit. After polishing, the central hub is attached to the drawn disc. The hub is configured to facilitate its assembly with a drawn disc by fitting it into the central hole in the disc and then deforming some of the metal of the disc to constrict securely about the hub. The hub is designed for mass production on conventional equipment. The inwardly facing side of the hub is provided with a threaded bore adapted to receive a threaded end of the yo-yo axle. The yo-yo halves then are assembled by attaching them to the threaded ends of an axle that may include additional axle assembly components, such as bearings, bearing surfaces or the like.

Among the objects of the invention are to provide a metal yo-yo and method for its manufacture that results in substantial economies; to provide a metal yo-yo in which each yo-yo half is formed from a separately formed disc and hub; to provide a metal yo-yo having a butterfly configuration; to provide a metal yo-yo in which the machining and finishing operations are minimized; and to provide a metal yo-yo construction in which the components of the yo-yo can be processed in batches and to provide a process for manufacturing such a yo-yo.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
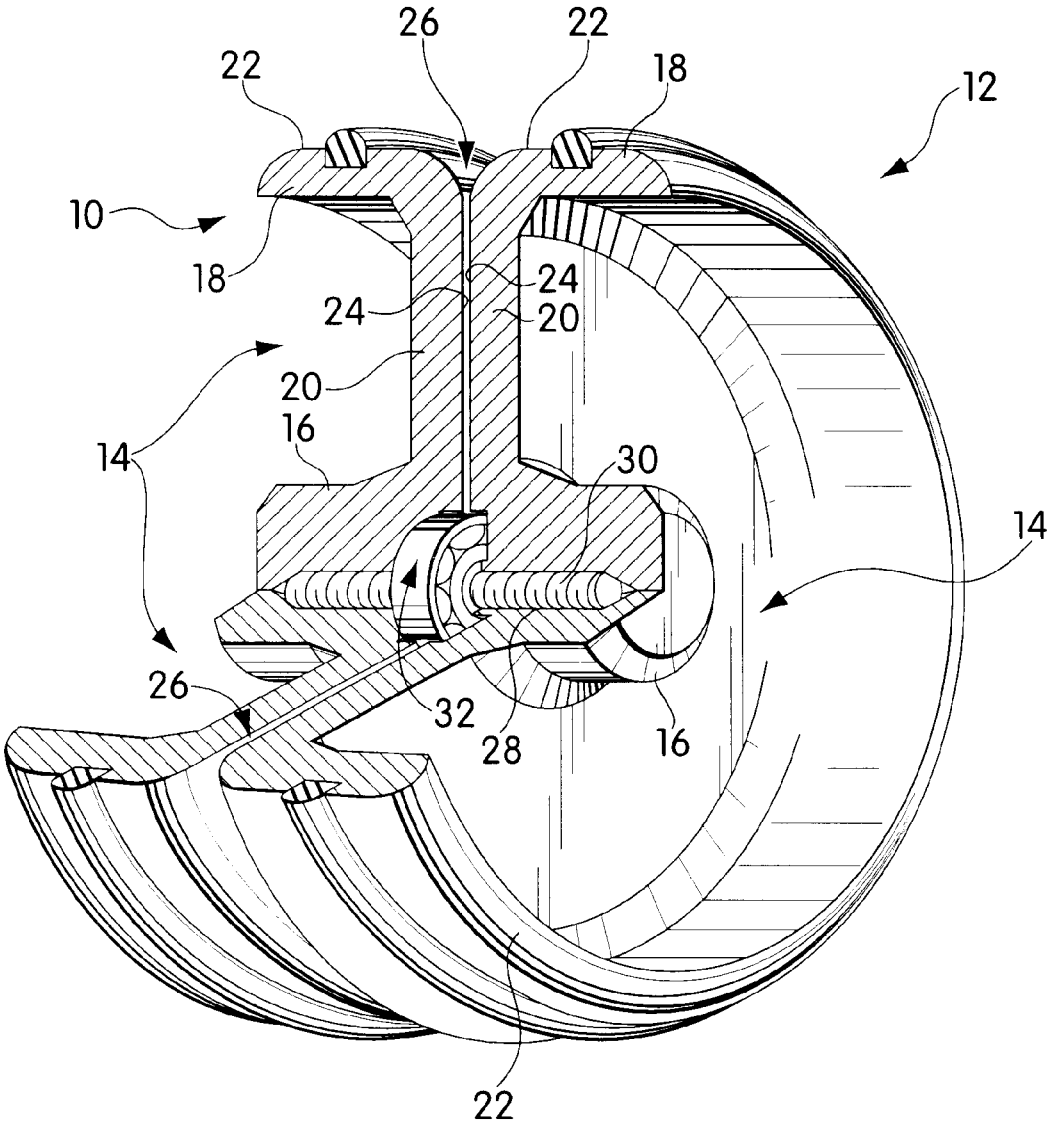
Fig. 1 PRIOR ART
FIG. 1 is a diagrammatic illustration, in quarter section, of a prior art metal yo-yo in which the halves have a one-piece machined construction.

FIG. 1 illustrates a metal yo-yo having a prior art construction in which each of the yo-yo halves 10, 12 is machined in one piece from metal bar stock. Each yo-yo half 10, 12 may be formed on a milling machine that exposes an end of round bar stock, for example, of aircraft grade aluminum. The outer end face of the bar stock is milled to remove a substantial amount of material leaving an annular region 14 that encompasses and defines a hub 16 and a peripheral rim 18, connected by a web 20.

The outer peripheral surface 22 of the rim also may be machined to a desired contour. The inner face 24 of each yo-yo half may be formed so that when mated with an identical yo-yo half, the inner faces 24 will define a string slot 26 as desired, for example, with the more radially inwardly disposed regions of the slot defining a narrower space than the more outwardly disposed regions. A hole 28 then is drilled and tapped at the inner face 24 of each yo-yo half. The threaded hole is adapted to receive the threaded end of an axle 30 by which the two yo-yo halves 10, 12 may be secured together. The axle hole 28 extends into the outwardly projecting hub 16 of the yo-yo half. The axle 30 may be part of an assembly that includes an appropriate bearing arrangement, indicated generally at 32 and may be a ball bearing or a bearing arrangement as that described in U.S. Pat. No. 4,895,547, the disclosure of which is incorporated by reference herein, in its entirety. Before assembly, a number of processes may be performed to enhance the appearance of the yo-yo, such as polishing, painting, graphic finishing, anodizing or the like. Where the yo-yo halve is machined from a single piece of material, as in the prior art described above, it does not lend itself to batch treatment with other yo-yo halves and can be expected to require individual finishing and fabrication. That, coupled with the expense of machining individual yo-yo halves, including the waste of material, results ultimately in a yo-yo that necessarily is very costly as compared to a yo-yo made from more conventional materials (e.g., plastic).

Figure 2:
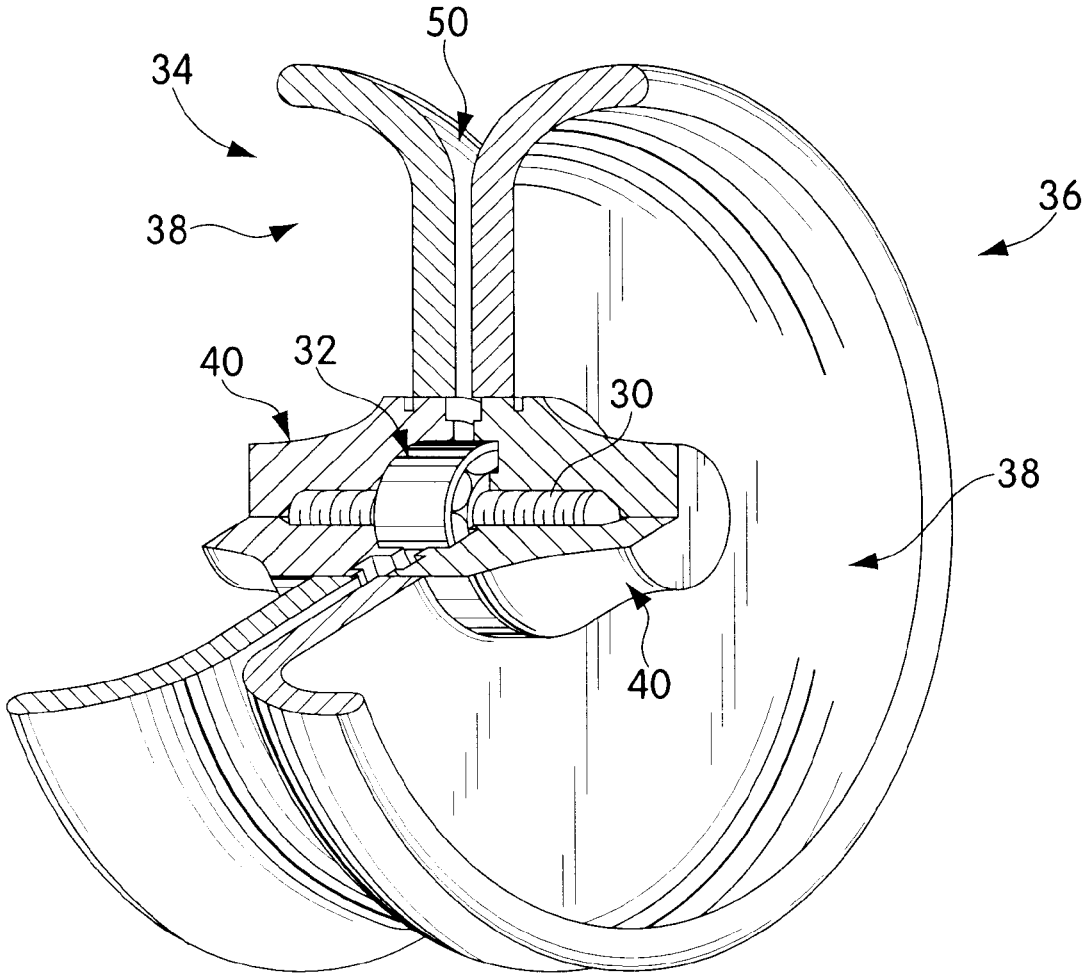
FIG. 2 is an illustration similar to FIG. 1, of a yo-yo made in accordance with the invention.

FIG. 2 illustrates a metal yo-yo embodying the invention. The yo-yo includes yo-yo halves 34, 36. The axle 30 and bearing arrangement 32 may be similar to or the same as that used in the embodiment of FIG. 1, a ball bearing being preferred. The yo-yo halves 34, 36, however, are fabricated from two components, a disc 38 and a hub 40, that are formed separately and then are combined and secured together to form the finished yo-yo half. The construction of the yo-yo half and its process for manufacture enables such yo-yos to be fabricated economically with a resultant cost substantially less than that of the type of yo-yo shown in FIG. 1.

Figure 3:
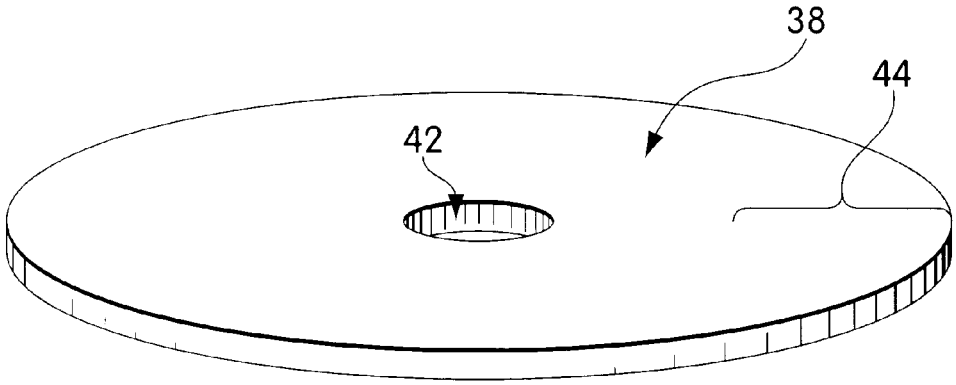
FIG. 3 is an illustration of a single flat disc that has been die cut from a sheet of metal.

FIG. 3 illustrates a disc 38 in its flat configuration after it has been cut, as by die cutting, from a flat sheet of material, preferably aluminum. A plurality of such discs can be die cut simultaneously from a flat sheet or strip of aluminum in a single die cut procedure. By way of example, an aluminum sheet 0.125 inch thick formed from an alloy that lends itself to being die cut and deformed (e.g., No. 3003-1114) may be cut to define discs with an outer diameter of 2.25 inches and having a center hole 42 about 0.50 inch in diameter. The sharp corners defined at the die break preferably are rounded slightly by machining or by using a progressive die cutting tool to coin the die break.

Figure 4:
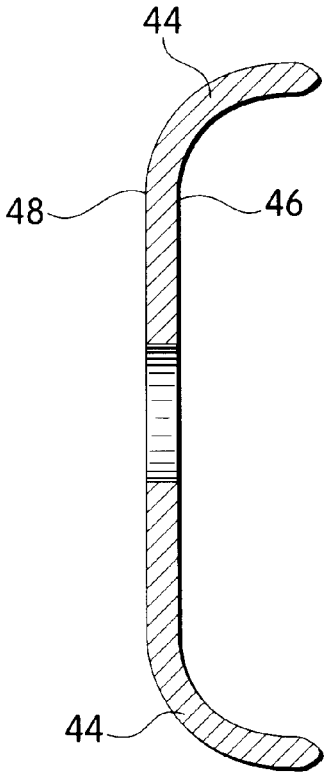
FIG. 4 is an illustration of a disc that has been stamped to deform it to a peripherally flared configuration.

FIG. 4 illustrates the disc 38 after it has been stamped in stamping dies (not shown) to deform the outer peripheral margin 44 of the disc to flare outwardly, defining somewhat of a dished shape. The disc 38, having been formed from a uniform thickness sheet, thus can be stamped to simultaneously define the shape and contour of the inner and outer faces 46, 48 of the yo-yo half. The contour of the stamping dies may be selected to control the configuration of the string slot 50 (FIG.2) and may be formed to include a substantial flare by which a butterfly-configured yo-yo will be formed when the yo-yo is assembled. Thus, the contour of the outer and inner faces 46, 48 can be formed simultaneously in a simple inexpensive operation in which there is minimal waste of material. Additionally, by embodying the foregoing construction and process, after the discs have been stamped, they may be polished in a batch (e.g., several hundred at a time) as by tumbling with an appropriate polishing grit to prepare the surface for further finishing, as desired. Where the disc is formed to its desired contour by bending, without machining, it does not have the machining marks that result from the prior art milling process and may be considered as already in a semi-finished state even before polishing.

Figure 5:
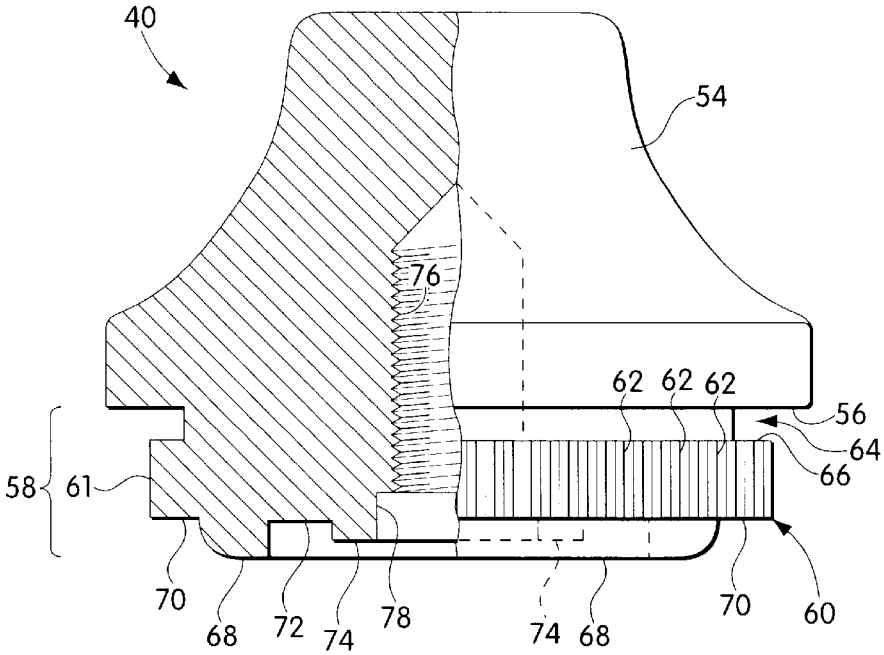
FIG. 5 is an enlarged quarter section illustration of the hub.
Figure 6:
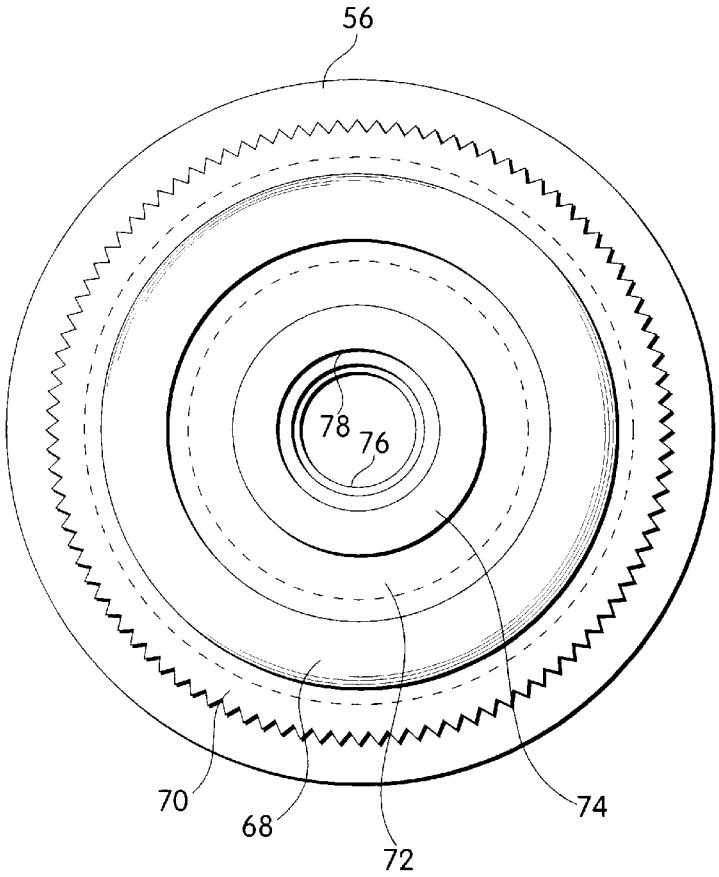
FIG. 6 is an illustration of the inner end of the hub as seen from the right of FIG. 5.
Figure 7:
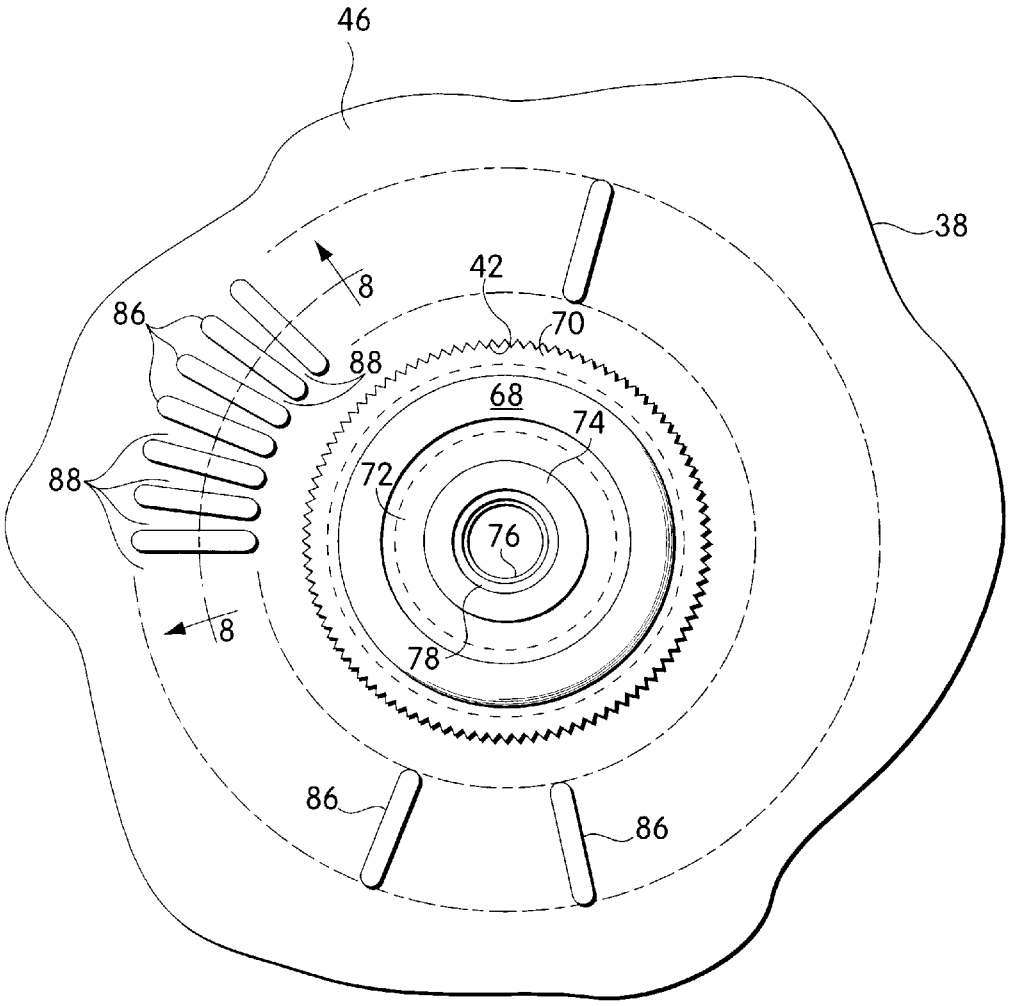
FIG. 7 is an illustration of the inner face of an assembled yo-yo half after the inner surface of the disc has been swaged.
Figure 8:
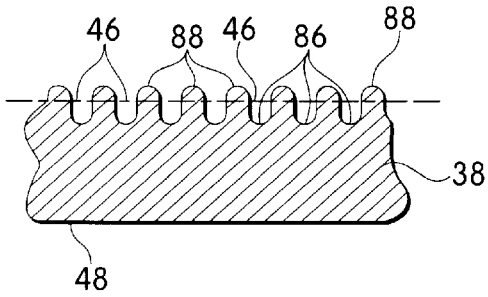
FIG. 8 is a sectional illustration of the region of the swaging as seen along the line 8—8 in FIG. 7.

FIGS. 5 and 6 illustrate the preferred embodiment of a hub adapted for secure connection to the formed disc to complete the structure of the yo-yo half. The hub, indicated generally at 40, may be formed from an aluminum alloy that lends itself to fabrication in an automatic screw machine, No. 2011 aluminum, being preferred. Such hubs 40 can be produced inexpensively and in substantial quantities, as on a Davenport multi-spindle automatic screw machine. The hub 40 includes an outer end 54 that will project outwardly into the dished region defined by the outer face 48 of the disc 38 after the parts are assembled. The hub 40 has an inwardly facing annular margin 56 with a diameter greater than that of the center hole 42 in the disc. When the hub 40 is assembled with a disc, the margin 56 of the hub 40 will bear firmly against the outer face 48 of the disc 38 in the marginal region about the center hole 42. The inner end of the hub is formed to include a projection 58 adapted to be closely fitted into the center hole 42 of the disc 38. The projection 58 is formed to include a locking band 60 having an outer peripheral surface 61 defined by a knurled pattern (e.g., a straight knurl of 128 diametral pitch) that can be fitted into the center hole 42 of the disc 38. The outer diameter of the locking band 60 is closely fitted to the diameter of the center hole 42 so that the two parts can be mated with relatively light force. So mated, the hub and disc, in the preferred embodiment then are secured firmly together by deforming the inner face of the disc, as by impacting or stamping with a die configured to form a plurality of impressions circumferentially spaced about the central axis of the yo-yo. The stamping serves to swage the disc to cause the metal of the disc to flow radially inward toward the central axis of the disc to constrict the disc tightly about the knurled surface of the locking band 60. A circumferential groove 64 preferably is formed between the inner face 56 of the outer end of the hub 40 and the outwardly facing surface 66 of the locking band 60. The groove 64 serves to provide space into which some of the metal (suggested at 63 in FIGS. 9 and 10) of the disc may cold flow as a result of the swaging operation. The deformed metal about the center hole 42 of the disc may flow into the groove 64 and engage the outer surface 66 of the locking band sufficiently to provide additional security to resist axial separation of the hub and the disc.

The swaging deforms the metal in a radially inward direction as well as causing the formation of a plurality of radially extending slightly raised ribs 88 that may be arranged in somewhat of a starburst pattern. The alternating ribs and depressions 88, 86 provide a less smooth annular surface that can enhance the ability of the string to become frictionally bound in the string slot near the axle of the spinning yo-yo when the yo-yo is manipulated to release tension on the string to initiate return of the yo-yo to the player.

Figure 9:
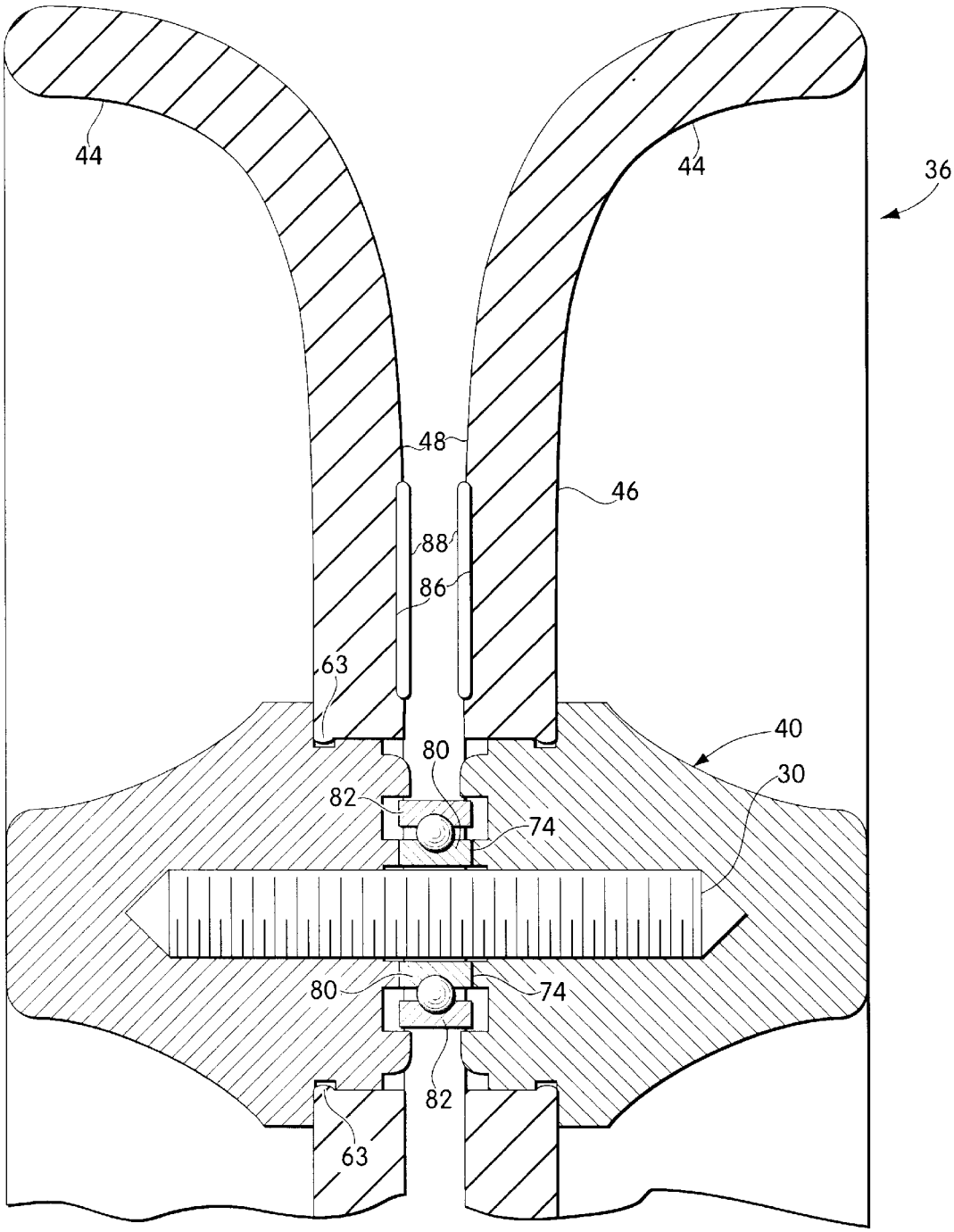
FIG. 9 is an enlarged full section illustration of the assembled yo-yo.
Figure 10:
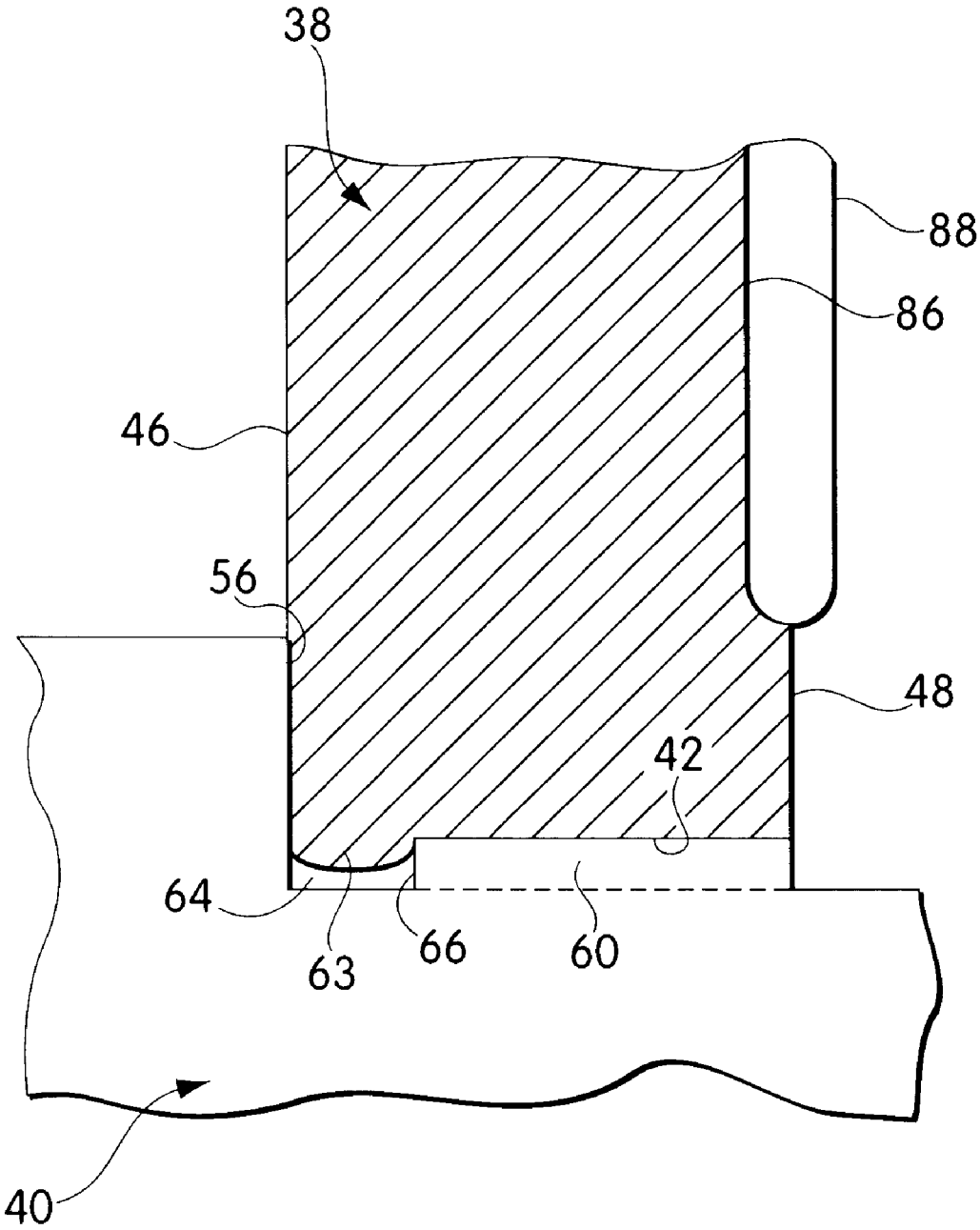
FIG. 10 is a further enlarged sectional illustration of a connection between the hub and the disc of a yo-yo half.

The assembled yo-yo preferably includes a bearing assembly 32 to which the yo-yo string can be attached which permits the body of the yo-yo to spin with reduced frictional losses. FIG. 9 illustrates a ball bearing assembly that includes an inner race 80 and an outer race 82. The inner race has a central hole that receives the axle 30 of the yo-yo. The inner surface of the hub 40 is configured to engage securely the inner race 80 so that the yo-yo and inner race 80 can spin relative to the outer race 82 that will be maintained stationary at the end of the string while the yo-yo is "sleeping". To that end, inner surface of the hub 40 is provided with an annular groove 72 that defines the outer periphery of a circular land 74. The land 74 is dimensioned to engage and clamp against the lateral side of the inner race 80 of the bearing. The radial dimension of the annular groove is large enough to receive the outer race 82 of the bearing without interfering with the ability of the outer race to spin about the axle of the yo-yo. A hole 76 is formed axially in the hub 40 and is counter-bored at its inner end at 78. The hole 76 is threaded to securely engage the threaded end of the axle 30. The foregoing arrangement enables the yo-yo to be assembled by placing a bearing assembly 32 on the axle and then screwing the assembled yo-yo halves onto the opposite ends of the axle. As the yo-yo halves are screwed together, they will be drawn closer together until their lands 74 engage the opposite sides of the inner race 80 of the bearing assembly, thus clamping the inner race 80 between the lands 74 of the hubs 40. So assembled, the axle, yo-yo halves, and inner race spin as a unit relative to the outer race 82, the yo-yo string being attached to the outer race. The dimensions of the land 74 and groove 72 are selected with respect to the bearing assembly 32 to permit the foregoing mode of operation as well as to define the width of the string slot between the two yo-yo halves.

The location and shape of the flared outer annular margin of the discs can be varied to vary the overall width of the yo-yo that, in turn, affects the feel of the yo-yo in the user's hand. The shape of the flared portion also may be varied in order to provide variance in the configuration of the entry to the string slot. In a preferred embodiment the disc is formed from aluminum sheet 0.125 inches thick and has a diameter of about 2¼ inches and a central hole 0.500 inches in diameter. The radially inner region of the disc may be substantially planar or may be provided with a slight deformity to provide a slight taper to the string slot. The peripherally flared portion of the disc preferably begins at about 0.825 inches radially outwardly of the central axis of the disc and preferably is provided with a relatively smooth, progressive curve that results in a total width of the stamped disc (measured axially) of about 0.45 inches. When the yo-yo is assembled, it may be configured so that it will have a string slot width of about slightly less than ⅛th inch (e.g., 0.100") with an overall yo-yo width of approximately 1 inch. Thus, the arrangement can provide a very wide butterfly entry at the outermost periphery of the assembled yo-yo, of approximately 1 inch, that progressively narrows to the string slot. When performing string tricks, the wide entry afforded by the butterfly configuration makes it easier for the user to catch the yo-yo between the ends of a length of the yo-yo string. It should be understood, however, that although the foregoing dimensional example is a presently preferred configuration, other dimensions for the various components may be employed with departing from the scope of the invention.

After each yo-yo half is assembled and may have been polished in a batch process, it may be coated to apply a finishing coat as desired. A preferred finishing process may comprise applying a powder coat with the desired coloring in a conventional electrostatic process in which the piece then is baked at an elevated temperature to cause the powder to form the desired finish surface.

From the foregoing it should be appreciated that the invention provides a yo-yo structure and method for its construction that enables a metal yo-yo to be made with less difficulty and at substantially less expense than with prior art metal yo-yos. The construction and method of fabrication enables substantial variation in the configuration of the yo-yo. It should be understood, however, that the foregoing description of the invention is intended merely to be illustrative thereof and that other modifications, embodiments and equivalents may be apparent to those skilled in the art without departing from its spirit.

Having thus described the invention what I desire to claim and secure by Letters Patent is:

1. A yo-yo comprising:

a pair of yo-yo halves, each yo-yo half being formed by separate metal disc and metal hub components secured to each other, each disc being formed from a metal sheet of substantially uniform thickness; and an axle connected at each of its ends to one of the hubs, the inwardly facing surfaces of the discs being spaced from each other to define a string slot.

2. A metal yo-yo as defined in claim 1 wherein the peripheral margin of each of the discs is flared outwardly.

3. A metal yo-yo as defined in claim 2 further comprising the peripheral margins of the discs being formed to define a butterfly configuration in which the space between the inner surfaces of the discs is substantially greater at the radially outward periphery of the yo-yo than at the more radially inwardly disposed regions of the string slot.

4. A metal yo-yo as defined in claim 2 wherein the discs are shaped to define a gradually progressing transition from the radially inwardly disposed portions of the string slot to the flared portions.

5. A metal yo-yo as defined in claim 1 wherein the hub is secured to its associated disc by compression of the disc about a portion of the hub.

6. A yo-yo as defined in claim 5 wherein the disc has a central hole and wherein the hub further comprises:

a member having inner and outer ends, the inner end being configured to be press fitted into the hole in the disc and the outer end extending outwardly beyond the outer face of the disc.

7. A yo-yo as defined in claim 6 further comprising:

the hub including an annular surface at the juncture of the inner and outer ends, the annular juncture being configured to bear against the outer surface of the disc about a marginal region surrounding the hole.

8. A metal yo-yo as defined in claim 5 further comprising:

the inner face of each disc being swaged to define a plurality of depressions disposed circumferentially about the radially inward portions of the disc by which the strength of the connection between the disc and the hub is enhanced.

9. A yo-yo as defined in claim 8 wherein the swaged region is defined by a plurality of circumferentially spaced depressions, the regions between the depressions defining ribs adapted to facilitate frictional engagement of the yo-yo string with the inner surfaces of the discs when tension is released from the yo-yo string.

10. A metal yo-yo as defined in claim 1 further comprising:

a bearing disposed about the axle, the bearing having inner and outer races, the inner end of each hub having a clamping pad formed thereon adapted to engage the inner race of the bearing, the inner race being clamped securely between clamping pads on the inner faces of the hub.

11. A metal yo-yo as defined in claim 10 further comprising:

the clamping pads being defined in part by an annular groove formed on the inner face of the hub, the annular groove having an outer radius greater than the outer radius of the outer race of the bearing.

12. A metal butterfly yo-yo as defined in claim 1 wherein the butterfly entry to the string slot is formed by outwardly flared peripheral marginal portion of the discs.

13. A metal yo-yo comprising:

a pair of yo-yo halves, each yo-yo half being formed by a metal disc having a central hole and a separate metal hub component secured to the disc;

an axle connected at each of its ends to one of the hubs, the inwardly facing surfaces of the discs being spaced from each other to define a string slot;

the hub having inner and outer ends, the inner end being configured to be press fitted into the hole in the disc and the outer end extending outwardly beyond the outer face of the disc;

the hub including an annular surface at the juncture of the inner and outer ends, the annular juncture being configured to bear against the outer surface of the disc about a marginal region surrounding the hole; and the inner end of the hub including a non-smooth surface arranged to define a diameter adapted to be closely fit into the central hole of its associated disc.

* * * * *